United States Patent [19]

Burgess et al.

[11] 3,931,020

[45] Jan. 6, 1976

[54] SMOKELESS FORGING LUBRICANT

[75] Inventors: Lester E. Burgess, Swarthmore; Sheldon A. Spachner, Havertown, both of Pa.

[73] Assignee: Gulf & Western Industries, Inc., New York, N.Y.

[22] Filed: Aug. 22, 1974

[21] Appl. No.: 499,436

[52] U.S. Cl. ..... 252/30; 72/42; 252/25; 252/49.5

[51] Int. Cl.[2] ..... C10M 1/10; C10M 3/02; C10M 5/02; C10M 7/02

[58] Field of Search ..... 72/42; 252/25, 30, 49.5

[56] References Cited

UNITED STATES PATENTS

| | | | |
|---|---|---|---|
| 3,637,498 | 1/1972 | Sawyer | 252/30 |
| 3,843,529 | 10/1974 | Bertrand | 252/25 |

*Primary Examiner*—Delbert E. Gantz
*Assistant Examiner*—I. Vaughn
*Attorney, Agent, or Firm*—Meyer, Tilberry & Body

[57] ABSTRACT

A lubricant for high temperature metal forging applications comprises a water soluble inorganic salt whose melting point is below the metal working temperature, in admixture with an inorganic salt which decomposes to a gas at temperature below the metal working temperature, and one or more particulate lubricants. The low melting point inorganic salt is sodium nitrite and the decomposible salt is sodium bicarbonate. The particulate lubricant material may be graphite and/or zinc oxide pigment powder. Water may be added to the mixture and, in such case, surfactants and thickening agents are added to the formulation. Minor amounts of other ingredients such as an anti-oxidant, may also be added to the water-based embodiments.

25 Claims, No Drawings

SMOKELESS FORGING LUBRICANT

The present invention is concerned with a lubricant for forging and extrusion operations in which metals are heated to an elevated temperature and the hot metals forged or otherwise worked by dies, presses or other appropriate metal forming tools.

More particularly, the invention is concerned with an improved smokeless lubricant with excellent lubrication properties and excellent ability to cling or adhere to the metal and tool surfaces to be lubricated, even at elevated metalworking temperatures, and excellent part-release properties.

The use of lubricants to lubricate metal and metal-forming tools during high temperature forging, or other operations, is of course well known in the art.

In high temperature metal working operations, such as forging operations, the hot metal billets or slugs, which are usually heated to a working temperature between about 1300°F to 2500° F, are hammered or stamped in a forging die, or the like, to form them into the desired shape. These dies, which are generally made of extremely hard alloy steel, are nonetheless subject to scoring and heat checking by the hot metal billets, which also have a tendency to be "welded" to the die. This causes rapid wearing and deterioration of these dies, which must then be discarded and replaced.

Another problem which arises with certain shaped parts forged in closed dies, is the difficulty of releasing the part from the die after it has been formed.

It is well known, of course, to ameliorate these problems by the use of a suitable lubricant to be employed during the high temperature metal forming operation.

The use of oil based lubricants has been long known in the art. Oil based lubricants have extremely good lubricating properties even under extremely high pressures such as are attained in metal working dies. However, oil based lubricants tend to decompose at the high temperatures involved and cause odor, large quantities of smoke and staining of the dies and workpieces.

It is also known in the art to employ water-base lubricants such as colloidal suspensions of graphite in water. For example, see U.S. Pat. No. 2,821,016 (W. M. Dickson, Jan. 28, 1958). Water-base lubricants are generally better coolants than oil based lubricants and not as susceptible to decomposition and smoking. However, water-base lubricants have the disadvantages that they are less adherent, i.e., they do not stick to the hot metal parts as well as do oil-based lubricants. Further, the water content of water-base lubricants causes corrosion of the dies and workpieces, and the stored lubricant is susceptible to hydration and phase separation of some components. It is well known in the art to attempt to overcome at least some of these shortcomings of water-base lubricants by adding various additives thereto. Accordingly, it is known to add anti-oxidants to overcome the corrosion problems and to add surfactants to assist in maintaining the graphite or other lubricant particles in suspension in the water base. One of the primary difficulties remaining is the low degree of adhesion of water-base lubricants to the heated dies and workpieces.

It is also known in the art to include inorganic salts in oil or grease lubricants. See U.S. Pat. No. 1,913,953 (R. S. Prendergast et al, June 13, 1933), U.S. Pat. No. 2,614,986 (A. Beerbower et al, Oct. 21, 1952) and U.S. Pat. No. 3,676,342 (A. Gathman, July 11, 1972). The use of inorganic salts in dilute water base lubricating agents is also known. See U.S. Pat. No. 3,046,225 (J. L. Murray et al, July 24, 1963), U.S. Pat. No. 3,177,144 (T. E. Reamer et al, Apr. 6, 1965), U.S. Pat. No. 3,249,538 (R. Freier, May 3, 1966) and U.S. Pat. No. 3,265,620 (D. K. Heiman, Aug. 9, 1966).

A very old patent, U.S. Pat. No. 343,943 (J. H. Brown, June 15, 1886) discloses the use of a mixture of inorganic salts, either dry or in water-paste form, for use as a lubricant for railroad car-axle bearings.

Other patents of general interest in the art which show the use of inorganic salts in lubricant compositions are U.S. Pat. No. 1,253,362 (K. Farkas, Jan. 15, 1918), U.S. Pat. No. 2,252,385 (G. H. Orozco, Aug. 12, 1941) and U.S. Pat. No. 3,679,459 (V. D. Rao et al, July 25, 1972).

It is accordingly an object of the present invention to overcome the foregoing problems and to provide a forging lubricant which can be used dry, or as a water base lubricant, which overcomes the difficulties and problems heretofore associated with water-base lubricants, and which provides a simple and inexpensive formulation which is a highly efficient lubricant, adheres well to dies and other parts to which it is applied, serves as a "lifting agent" to help separate formed parts from dies, does not cause smoking or other decomposition problems associated with oil base lubricants, and may be applied by spraying, brushing, dipping, or sprinkling in paste or dry powder form.

In accordance with the present invention, a metal working lubricant comprises a mixture of inorganic salts, including sodium bicarbonate and sodium nitrite, at least one of which (sodium nitrite) melts at or below the metal working temperature at which it is to be used, and at least one of which (sodium bicarbonate) decomposes to a gas at or below the metal working temperature, in combination with particulate lubricants.

The low melting temperature inorganic salt acts as a vehicle which adheres to heated metal surfaces and thereby holds the particulate lubricant to the surface to be protected. The melted salt itself also has lubricating properties. The decomposible inorganic salt forms a gaseous interface between the parts to be lubricated, thus serving both a lubricating function and a "lifting agent" function by helping to separate the part from the die by virtue of the pressure of the evolved gas. The decomposition to a gas may be explosive in nature, literally lifting the part out of the die. Naturally, the low melting point salt may decompose and the decomposible salt may melt at certain temperatures within the metal working range.

In accordance with one aspect of the invention, the inorganic salts employed are water soluble.

In accordance with one aspect of the invention, the decomposible inorganic salt is sodium bicarbonate, the low melting point inorganic salt is sodium nitrite, and the particulate lubricant is selected from the class consisting of graphite and zinc oxide. Zinc oxide will not carbonize steel as do organic lubricants, i.e., oil. The sodium nitrite melts and adheres well to hot metal surfaces.

In one embodiment of the invention, sufficient water is added to the aforesaid composition to prepare a thick paste, and minor amounts of a suitable surfactant and anti-oxidant are added to the composition. Other ingredients may be added in minor amounts to adjust the pH of the solution or of components thereof.

The decomposition point (to yield $CO_2$ gas) of sodium bicarbonate is about 270°C (518.0° F) and the melting point of sodium nitrite is about 271° C (519.8°F). Zinc oxide sublimates at about 1800°C (3,272. °F) and graphite sublimates at about 3,500°C (6,332°F). Consequently, at any point throughout the usual range of metal working temperatures, e.g., 1,300°F to 2,600° F(704.4°C to 1,426.7° C), the nitrite salt will melt, the bicarbonate will decompose, and the lubricant particles will be stable.

In a typical operation, for example, the forming of steel plugs in a 50 ton metal working press, the press plates are heated to about 700°F to 800°F(371. °C to 426.7°C) and the metal slugs to be worked are heated to about 2,200°F (1204.4°C). The lubricant of the invention applied in dry powder or paste form as convenience dictates, adheres to surfaces to be lubricated, by virtue of the fact that the sodium nitrite melts and clings to the heated surfaces, keeping the particulate lubricant particles in contact therewith, and the sodium bicarbonate decomposes to form a gaseous interface between adjacent heated surfaces.

In general, at the lower end of the metal working temperature range, a lower ratio of inorganic salts (sodium bicarbonate, sodium nitrite) to particulate lubricant is preferred, and at the higher end of the metal working temperature range, a higher proportion of the inorganic salts to particulate lubricant is preferred.

A wide range of proportions of the essential ingredients (sodium bicarbonate, sodium nitrite, and particulate lubricant) may be utilized, depending on the particular mode of application of the lubricant and the temperature range involved. In general, the proportion range of essential ingredients is as follows in Tables I and II.

TABLE I

| Dry Lubricant<br>Ingredient | Weight Percent |
|---|---|
| Sodium bicarbonate ($NaHCO_3$) | 25% –76% |
| Sodium nitrite ($NaNO_2$) | 8% –32% |
| Particulate lubricant | 5% –65% |

TABLE II

| Water Base Lubricant<br>Ingredient | Weight Percent |
|---|---|
| Sodium bicarbonate ($NaHCO_3$) | 10%–55% |
| Sodium nitrite ($NaNO_2$) | 3%–15% |
| Particulate lubricant | 4%–40% |
| Minor ingredients (surfactant, thickening agent,etc) | Less than 1% |
| Water | Balance |

The particulate lubricant may be zinc oxide, graphite, or a mixture thereof.

As used in the claims, the term "thickening agent" includes chemicals (such as sodium hydroxide) added thereto to adjust the pH thereof.

For best results, it has been found that the ratio of the total weight of inorganic salts (sodium bicarbonate and sodium nitrite) to the total weight of particulate lubricants should be varied, depending on the metal working temperature involved. At the low end (about 1300°F) of the metal working temperature range, a low ratio (as low as 0.4:1) of inorganic salts: particulate lubricant is preferred. At the high end (about 2600°F) of the metal working temperature range a high ratio (as high as 17:1) of inorganic salts: particulate lubricant is preferred.

The invention may be better understood by referring to the following detailed description of specific embodiments thereof.

A dry smokeless forging lubricant of good lubricity and with the ability to cling satisfactorily to forging dies consists of the following ingredients in the proportions given.

TABLE III

| Ingredients | Parts by Weight | Example |
|---|---|---|
| Sodium Bicarbonate ($NaHCO_3$) | 40–60 | 2000–3000 grams |
| Sodium Nitrite ($NaNO_2$) | 10–30 | 500–1500 grams |
| Graphite | 3–6 | 150–300 grams |

The graphite is "Superflake" brand graphite, manufactured by Superior Graphite Company, or the equivalent.

The foregoing provides a black, smokeless lubricant powder which may be directly applied to forging dies which, upon being heated to working temperature, say 700° to 800°F, in order to process billets heated to, say, 2,200°F, will cause the sodium nitrite to melt and the sodium bicarbonate to rapidly decompose to yield carbon dioxide gas. The melted salt serves as a binder, clinging to the die or plate surfaces and holding the graphite particles suspended therein.

If it is desired to apply the lubricant in the form of a paste, sufficient water is added so that the total mixture of the example makes on gallon of volume. Minor amounts of Triton QS44 brand surfactant (manufactured by Rohm and Haas Company) or the equivalent together with 10 to 20 grams of Carbopol 904 brand anti-oxidant (manufactured by The B. F. Goodrich Company) or the equivalent are desirably also included.

A white smokeless forging lubricant comprises the following formulation:

Table IV

| Formula II<br>Ingredients | Parts by Weight | Example |
|---|---|---|
| Sodium Bicarbonate | 40–60 | 2000–3000 grams |
| Sodium Nitrite | 10–30 | 500–1500 grams |
| Zinc Oxide | 3–6 | 150–300 grams |

The zinc oxide is a pigment powder grade of zinc oxide, or the equivalent.

The foregoing forms a white smokeless forging lubricant powder of similar characteristics to the black smokeless forging lubricant powder of Formula I.

As with the case of the black lubricant powder, water and surfactant and anti-oxidant as above may be added to make a paste.

The lubricant, whether in powder or paste form, may be applied by any suitable method, such as dripping, brushing, swabbing, dry rolling or spraying the powder or paste onto the part or parts to be lubricated.

Because the lubricant may be employed as a dry powder mixture, it can be applied by sprinkling or dusting, in a manner not feasible with liquid or paste lubricants. Also, the dry powder formulation avoids the necessity for surfactants, anti-oxidants or other additives, thus providing a simpler, readily usable formulation.

The composition of the invention employs selected water-soluble inorganic salts in either powder or paste form (water base) so that at least one of the inorganic salts melts and adheres to the hot surfaces to be lubricated, and at least one decomposes to form a gas. The particular salts selected overcome prior art deficiencies of difficult adhesion, phase separation and hydration of ingredients.

A test comparing a lubricant formula made in accordance with the invention and the prior art formulation disclosed in the above-mentioned U.S. Pat. No. 343,943 to J. H. Brown, was carried out.

Three lubricant formulations were prepared as follows:

| | | |
|---|---|---|
| Lubricant A— | Sodium bicarbonate | 51 grams |
| | Sodium nitrite | 14 grams |
| | Graphite | 5 grams |
| | Water | 30 grams |
| | Viscosity and settling control ingredients 1 gram | |
| Lubricant B— | Sodium carbonate | 51 grams |
| | Potassium nitrate | 14 grams |
| | Graphite | 5 grams |
| | Water | 30 grams |
| | Viscosity and settling control ingredients 1 gram | |
| Lubricant C— | Sodium carbonate | 32 grams |
| | Potassium nitrate | 32 grams |
| | Graphite | 6 grams |
| | Water | 30 grams |

The composition of lubricant A is in accordance with the teachings of this invention; that of Lubricant B utilizes the ingredients disclosed in the Brown patent in the same proportion as the closest equivalent ingredients in the composition of applicant's Lubricant A, and the composition of Lubricant C is in accordance with the disclosure in the Brown patent.

After preparation, a portion of each of the three Lubricants was stored with the following results. Lubricant A was stable, except for soft settling of some of the solids in the liquid over a period of several months. Both Lubricant B and Lubricant C, after about three days, formed a solid, damp mass. Apparently, a hydration reaction occurred.

Freshly prepared formulations of Lubricants A, B, and C were tested in the forging of steel slugs. In separate lubricant application tests, each of these lubricant formulations was applied to the surfaces of a forging die heated to between about 700°F to 800°F. Lubricant A spread well when brushed onto the die surfaces. Brush marks were observed as the material was spread. Both Lubricant B and Lubricant C boiled and "balled-up" on application, forming small spheroids on the die surfaces. It was necessary to practically pour these latter two lubricants onto the die surfaces to attain sufficient coverage to conduct the forging tests described below.

In separate forging tests, a steel slug, heated to about 2,200°F was compressed under a lubricated forging die, which had been lubricated as described above in connection with the application tests. The forging dies were heated to between about 750°F to 800°F. Overall, Lubricant A provided "coins" forged from the slugs, which coins had diameters about 10 to 20% greater than those obtained under otherwise identical conditions with Lubricant B or C. This indicates, at least qualitatively, the great lubricity of Lubricant A as compared to either Lubricant B or Lubricant C.

The formulation of the Brown patent was chosen for comparison with a formulation in accordance with the invention because Brown teaches using his lubricant composition in dry or paste form, and in this respect is closer to applicant's teaching than any of the other prior art of which applicant is aware. However, it is noted that Brown teaches utilization of his lubricant formulation in connection with lubricating bearings and not for use at the substantially higher temperatures involved in metal forming operations.

In any event, the test results clearly indicate the inadequacy of the Brown composition for use in metal forming operations. This is not intended to deprecate in any way the teachings of the Brown disclosure, which, as aforesaid, deals with a formulation for lubricating bearings, a less rigorous application for a lubricant than metal working.

The following table gives a number of specific lubricant formulations in accordance with the present invention, which formulations have been successfully tested in metal forming operations. All the formulations provided excellent lubricating characteristics and part release from the forming die.

TABLE V

| Formulation Ingredient | EXAMPLES M-3 lbs. | M-3 wt% | M-7 lbs. | M-7 wt% | M-9 lbs. | M-9 wt% | No. 3 Swab lbs. | No. 3 Swab wt% |
|---|---|---|---|---|---|---|---|---|
| Sodium bicarbonate | 177.00 | 44.23 | 125.00 | 31.27 | 49.95 | 12.43 | 102.00 | 51.00 |
| Sodium nitrite | 47.50 | 11.90 | 28.00 | 7.00 | 15.00 | 3.75 | 28.00 | 14.00 |
| Surfactant (Triton QS44 Brand) | 0.12 | 0.03 | 1.53 | 0.38 | 0.84 | 0.21 | 1.00 | 0.50 |
| Graphite | 24.00 | 6.00 | 150.00 | 37.50 | 118.00 | 29.55 | 9.50 | 4.75 |
| Thickening Agent Carbopol | 0.14 | 0.04 | 1.80 | 0.45 | 0.73 | 0.18 | 0.50 | 0.25 |
| Sodium Hydroxide | 0.40 | 0.10 | 0.40 | 0.10 | 0.07 | 0.02 | 0.20 | 0.10 |
| Water | 150.84 | 37.70 | 93.27 | 23.30 | 215.41 | 53.86 | 58.80 | 29.40 |
| TOTAL | 400 | 100 | 400 | 100 | 400 | 100 | 200 | 100 |

TABLE VI

| | WEIGHT PERCENT RANGE OF INGREDIENTS OF TABLE I EXAMPLES M-3 | M-7 | M-9 | No. 3 Swab |
|---|---|---|---|---|
| Sodium Bicarbonate | 42–46% | 29–33% | 11–14% | 49–53% |
| Sodium Nitrite | 11–13% | 6– 8% | 3– 5% | 13–15% |
| Graphite | 5– 7% | 35–39% | 27–32% | 3½–5½% |
| Water | 35–39% | 21–25% | 51–55% | 27–31% |

The formulations identified as M3, M7 and M9 in the above table are particularly adapted to be applied to the surfaces to be lubricated by being sprayed on by any suitable applicator spray. The formulation identified as "No. 3 Swab", is particularly adapted to be applied by brushing onto the surfaces to be lubricated.

The graphite formulations given in the above table are black in color. Corresponding formulations white in color may be prepared by substituting for the indicated quantity of graphite formulations, the identical quantity of zinc oxide.

In each case (including corresponding zinc oxide formulations), the formulation is prepared as follows. To a major portion, but not all, of the water to be included in the formulation, is added the entire specified quantity of sodium bicarbonate, sodium nitrite and the (Triton brand)surfactant. This mixture is stirred in a high speed mixer until the ingredients are dissolved and/or dispersed. The graphite (or, alternatively, the zinc oxide) is then added to the mixture with stirring to disperse the particles of graphite or zinc oxide into the solution. The surfactant helps to maintain these particles suspended in the liquid.

The thickening agent is mixed in a separate container with the remainder of the water and the sodium hydroxide is added thereto. The sodium hydroxide neutralizes the acidity of the thickening agent, which would otherwise tend to react with sodium nitrite to form nitrous oxide. The thickening agent and water mixture, adjusted with the sodium hydroxide, forms a gelatinous mass which is added with stirring to the main body of the formulation. The result is a thickened paste-like mixture, which may be applied by brushing or spraying.

Table V shows the following weight ratios of inorganic salts to particulate lubricant for, respectively, the M-9, M-7, M-3 and No. 3 Swab formulations; 0.45:1, 1.02:1, 9.2:1, and 13.7:1. Accordingly, the M-9 and M-7 formulations are preferable for use in metal working operations near the lower end of the metal working temperature range (1300°F to 2600°F) and the M-3 and No. 3 Swab near the higher end of this range.

Naturally, the formulation proportion may be varied considerably and may be used at any point within the metal working temperature range, but best results are believed obtained if these proportions roughly correspond to the corresponding point within the metal working temperature range.

While the invention has been described in detail with reference to specific embodiments thereof, it will be apparent that numerous modifications and alterations and additions thereto may be made by those skilled in the art after a reading and understanding of the foregoing description. It is intended to include all such modifications, alterations, and additions within the scope of the appended claims.

What is claimed is:

1. A lubricant for metal working operations comprises a mixture of sodium bicarbonate, sodium nitrite, and a particulate lubricant selected from the group consisting of graphite and zinc oxide.

2. The lubricant of claim 1, wherein the proportion by weight of the sum of sodium bicarbonate and sodium nitrite to particulate lubricant is between about 0.4:1 to about 17:1.

3. The lubricant of claim 1 further including water.

4. The lubricant of claim 1 wherein the essential ingredients thereof are present in the following proportions by weight percent of the total weight of lubricant:

| | |
|---|---|
| Sodium bicarbonate | 25% to 76% |
| Sodium nitrite | 8% to 32%, and |

-continued

| | |
|---|---|
| Particulate lubricant | 5% to 65%. |

5. The lubricant of claim 3 wherein the water and essential ingredients are present in the following proportions by weight percent of the total weight of lubricant:

| | |
|---|---|
| Sodium bicarbonate | 10%–55% |
| Sodium nitrite | 3%–15% |
| Particulate lubricant | 4%–40% |
| Water and minor ingredients | Balance |

6. The lubricant of claim 5 further including a total of less than 1% by weight surfactant and thickening agent.

7. A lubricant for metal working operations including the following ingredients present in the following proportions by weight percent of the total weight of the lubricant:

| | |
|---|---|
| Sodium bicarbonate | 42%–46% |
| Sodium nitrite | 11%–13% |
| Particulate lubricant | 5%– 7% |
| Water | 35%–39% |

wherein the particulate lubricant is selected from the class consisting of graphite and zinc oxide.

8. The lubricant of claim 7 further including a total of less than 1% by weight of a thickening agent and a surfactant.

9. A lubricant for metal working operations including the following ingredients present in the following proportions by weight percent of the total weight of lubricant:

| | |
|---|---|
| Sodium bicarbonate | 29%–33% |
| Sodium nitrite | 6%– 8% |
| Particulate lubricant | 35%–39% |
| Water | 21%–25% |

wherein the particulate lubricant is selected from the class consisting of graphite and zinc oxide.

10. The lubricant of claim 9 further including a total of less than 1% by weight of a thickening agent and a surfactant.

11. A lubricant for metal working operations including the following ingredients present in the following proportions by weight percent of the total weight of lubricant:

| | |
|---|---|
| Sodium bicarbonate | 11%–14% |
| Sodium nitrite | 3%– 5% |
| Particulate lubricant | 27%–32% |
| Water | 51%–55% |

wherein the particulate lubricant is selected from the class consisting of graphite and zinc oxide.

12. The lubricant of claim 11 further including a total of less than 1% by weight of a thickening agent and a surfactant.

13. A lubricant for metal working operations including the following ingredients present in the following proportions by weight percent of the total weight of lubricant:

| | |
|---|---|
| Sodium bicarbonate | 49%–53% |
| Sodium nitrite | 13%–15% |
| Particulate lubricant | 3½%–5½%, |

-continued

| | |
|---|---|
| Water | 27%–31% |

wherein the particulate lubricant is selected from the class consisting of graphite and zinc oxide.

14. The lubricant of claim 13 further including a total of less than 1% by weight of a thickening agent and a surfactant.

15. The lubricant of claim 3 further including a surfactant and a thickening agent.

16. The lubricant of claim 1 wherein the particulate lubricant is graphite.

17. The lubricant of claim 4 wherein the particulate lubricant is graphite.

18. A lubricant for metal working operations including the following ingredients present in the following proportions by weight percent of the total weight of the lubricant:

| | |
|---|---|
| Sodium bicarbonate | 42%–46% |
| Sodium nitrite | 11%–13% |
| Graphite | 5%– 7% |
| Water | 35%–39% |

19. The lubricant of claim 18 further including a total of less than 1% by weight of a thickening agent and a surfactant.

20. A lubricant for metal working operations including the following ingredients present in the following proportions by weight percent of the total weight of lubricant:

| | |
|---|---|
| Sodium bicarbonate | 29%–33% |

-continued

| | |
|---|---|
| Sodium nitrite | 6%– 8% |
| Graphite | 35%–39% |
| Water | 21%–25% |

21. The lubricant of claim 20 further including a total of less than 1% by weight of a thickening agent and a surfactant.

22. A lubricant for metal working operations including the following ingredients present in the following proportions by weight percent of the total weight of lubricant:

| | |
|---|---|
| Sodium bicarbonate | 11%–14% |
| Sodium nitrite | 3%– 5% |
| Graphite | 27%–32% |
| Water | 51%–55% |

23. The lubricant of claim 22 further including a total of less than 1% by weight of a thickening agent and a surfactant.

24. A lubricant for metal working operations including the following ingredients present in the following proportions by weight percent of the total weight of lubricant:

| | |
|---|---|
| Sodium bicarbonate | 49%–53% |
| Sodium nitrite | 13%–15% |
| Graphite | 3½%–5½% |
| Water | 27%–31% |

25. The lubricant of claim 24 further including a total of less than 1% by weight of a thickening agent and a surfactant.

* * * * *